US005727721A

United States Patent [19]

Guido et al.

[11] Patent Number: 5,727,721

[45] Date of Patent: Mar. 17, 1998

[54] FLEXIBLE WEB DISPENSER

[76] Inventors: Joseph Jerome Guido, deceased, late of Hinsdale; by Marguerite McGrath Guido, trustee, 135 E. 5th St.; Robert Joseph Guido, 641 S. Bodin, both of Hinsdale, all of Ill. 60521

[21] Appl. No.: 754,626

[22] Filed: Nov. 21, 1996

Related U.S. Application Data

[60] Provisional application No. 60/007,683 Nov. 29, 1995.

[51] Int. Cl.[6] ..... B26F 3/02

[52] U.S. Cl. ..... 225/106; 225/46; 221/63

[58] Field of Search ..... 225/34, 39, 43, 225/46, 52, 76, 77, 80, 91, 106; 221/33, 34, 63; 211/16, 45, 592

[56] References Cited

U.S. PATENT DOCUMENTS

| | | | |
|---|---|---|---|
| Re. 34,324 | 7/1993 | Haenni et al. . | |
| 441,669 | 12/1890 | Jones . | |
| 1,122,673 | 12/1914 | Winter et al. . | |
| 2,030,602 | 2/1936 | McDonough et al. . | |
| 3,002,668 | 10/1961 | Castelli . | |
| 3,180,557 | 4/1965 | Thulin . | |
| 3,269,593 | 8/1966 | Lodewick et al. . | |
| 3,482,761 | 12/1969 | Suominen et al. . | |
| 3,494,518 | 2/1970 | Goss | 225/46 |
| 3,771,700 | 11/1973 | Garr . | |
| 3,868,052 | 2/1975 | Rockefeller . | |
| 3,958,768 | 5/1976 | Fairbanks . | |
| 3,982,659 | 9/1976 | Ross . | |
| 3,986,479 | 10/1976 | Bonk . | |
| 3,994,417 | 11/1976 | Boedecker . | |
| 4,181,218 | 1/1980 | Cox . | |
| 4,191,307 | 3/1980 | LeClaire, Jr. et al. . | |
| 4,191,317 | 3/1980 | Harkins | 225/46 |
| 4,289,262 | 9/1981 | Finkelstein . | |
| 4,526,291 | 7/1985 | Margulies . | |
| 4,535,912 | 8/1985 | Bonk . | |
| 4,635,837 | 1/1987 | Granger | 225/106 |
| 4,648,530 | 3/1987 | Granger . | |
| 4,692,134 | 9/1987 | dos Santos Copia . | |
| 4,759,742 | 7/1988 | Achelpohl . | |
| 4,786,275 | 11/1988 | Hoover . | |
| 4,790,437 | 12/1988 | Pistner . | |
| 4,793,539 | 12/1988 | Haenni et al. . | |
| 4,807,754 | 2/1989 | Rowe . | |
| 4,846,349 | 7/1989 | Galimberti . | |
| 4,846,415 | 7/1989 | Jernberg et al. | 225/46 |
| 4,859,082 | 8/1989 | Llorens et al. . | |
| 4,911,560 | 3/1990 | Hoover et al. . | |
| 4,930,385 | 6/1990 | Wilfong, Jr. et al. . | |
| 5,024,349 | 6/1991 | Haenni et al. . | |
| 5,096,305 | 3/1992 | Rimondi et al. . | |
| 5,135,134 | 8/1992 | Dancy . | |
| 5,209,371 | 5/1993 | Daniels . | |
| 5,480,084 | 1/1996 | Daniels | 225/106 |
| 5,566,873 | 10/1996 | Guido | 221/63 |

FOREIGN PATENT DOCUMENTS

| | | |
|---|---|---|
| 1107603 | 4/1975 | Japan . |
| 1 325 923 | 8/1973 | United Kingdom . |

*Primary Examiner*—Maurina T. Rachuba
*Attorney, Agent, or Firm*—Fitch, Even, Tabin & Flannery

[57] ABSTRACT

A dispenser for web articles such as plastic bags which are torn from the web includes a support for the webbing, pivotally mounted in a frame. The support and frame each include jaws defining a nozzle through which the webbing passes. The weight of the support and of the webbing draws the jaws together in a clamping action, so as to frictionally engage the webbing, preparatory to tearing.

30 Claims, 12 Drawing Sheets

FLEXIBLE WEB DISPENSER

CROSS REFERENCE TO RELATED APPLICATIONS

This application claims the benefit of Provisional Application Ser. No. 60/007,683 filed Nov. 29, 1995.

BACKGROUND OF THE INVENTION

1. Field of the Invention

The present invention pertains to product items made from flexible webbing, and in particular to product items joined together in a serial succession along lines of weakness.

2. Description of the Related Art

A number of dispensers have been proposed for plastic bags, including T-shirt plastic bags. These items are typically joined together along lines of weakness in a serial succession to form a continuous web. The web may be fan-folded, but is usually provided in roll form. U.S. Pat. Nos. 5,024,349; 5,209,371 and Reissue 34,324 all propose dispensers for these types of bags. U.S. Pat. No. 5,209,371, for example, teaches a frame of welded wire construction. A roll of plastic T-shirt bags is received in a cradle and is paid out over a wire member. Improvements in gripping the webbing so as to more carefully control tearing of the webbing along lines of weakness is still being sought.

Dispensers have been proposed for rolls of paper towels, and examples are found in U.S. Pat. Nos. 1,122,673 and 2,030,602. However, these dispensers are not particularly suited for dispensing plastic webbing. Dispensers for other types of plastic webbing, such as that described in U.S. Pat. No. 5,135,134, have also been found to be unsuitable.

Accordingly, the need still exists for a dispenser for T-shirt bags in which the bags are dispensed one at a time as they are torn from a continuous roll.

SUMMARY OF THE INVENTION

It is an object of the present invention to provide a dispenser for flexible webbing, especially dispensable webbing comprising a serial succession of articles joined together along lines of weakness.

Another object according to principles of the present invention is to provide a dispenser which offers improved support of the webbing as articles are torn therefrom.

A further object of the present invention is to provide a dispenser with improved control of the webbing during tearing, as indicated above, and which provides a balance between allowing the webbing to be easily withdrawn from the dispenser and frictionally engaging the webbing so as to allow a user to reliably tear articles from the webbing using only a single hand, thus freeing the other hand for other tasks.

These and other objects according to principles of the present invention are provided in a dispenser for flexible webbing having a free end and comprising a serial array of articles joined end to end along lines of weakness, the dispenser comprising:

a first frame member including a first jaw member;

a second frame member for supporting a supply of the webbing as the free end is withdrawn from the first frame member, said second frame member including a second jaw member;

pivotal mounting means for mounting the second frame member for pivotal movement with respect to the first frame member, between open and closed positions so as to move the first and the second jaw members toward and away from each other;

the first and the second jaw members cooperating to form a dispensing nozzle for guiding the webbing as the webbing is passed between the first and the second jaw members and for supporting the webbing with a frictional engagement as articles are severed by tearing along lines of weakness; and the pivotal mounting means arranged so that the weight of the webbing urges the first and the second jaw members together so as to form the dispensing nozzle and to frictionally engage the webbing.

DETAILED DESCRIPTION OF THE PREFERRED EMBODIMENTS

Figure 1:
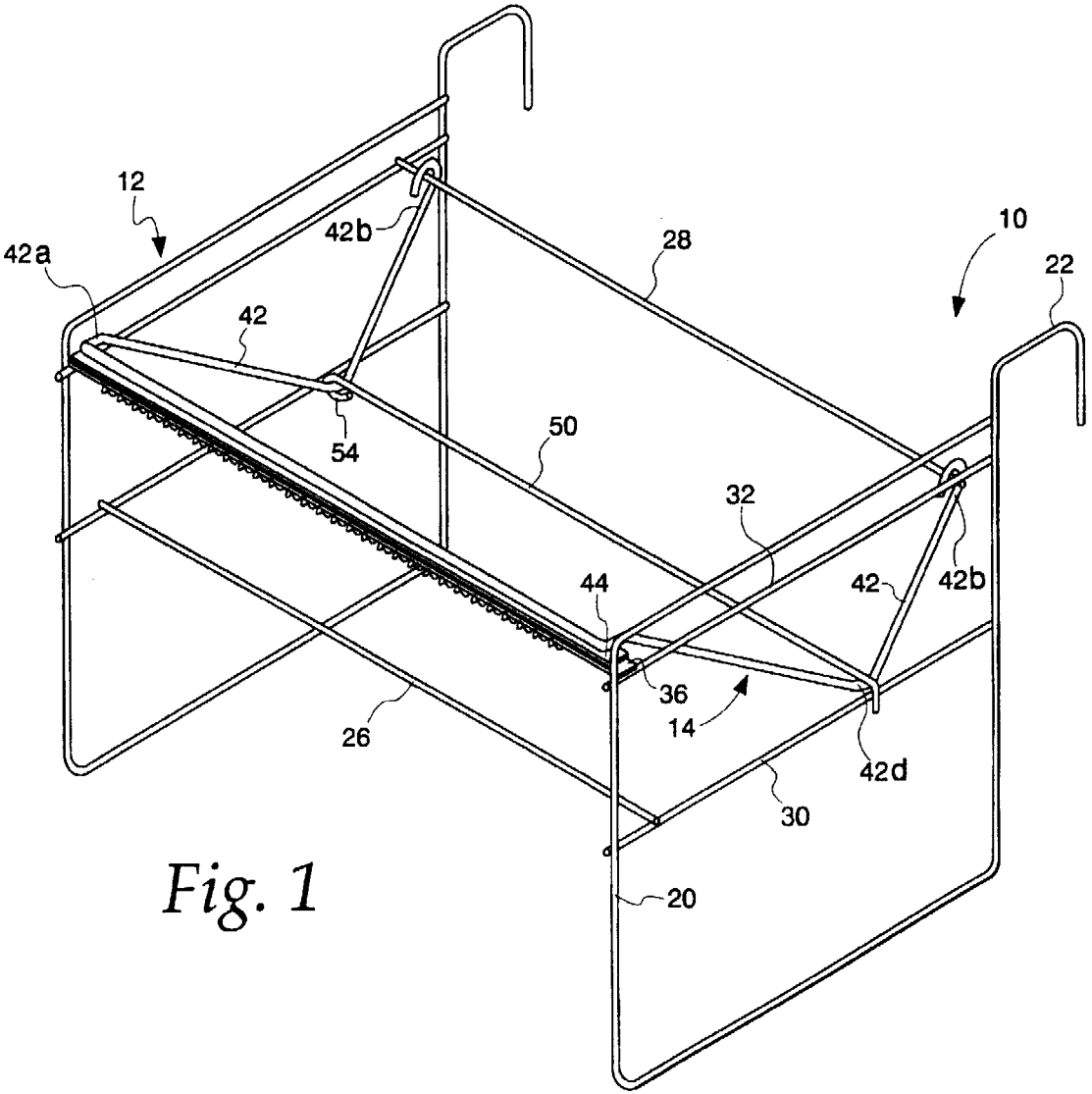
FIG. 1 is a perspective view of a dispenser according to principles of the present invention.
Figure 2:
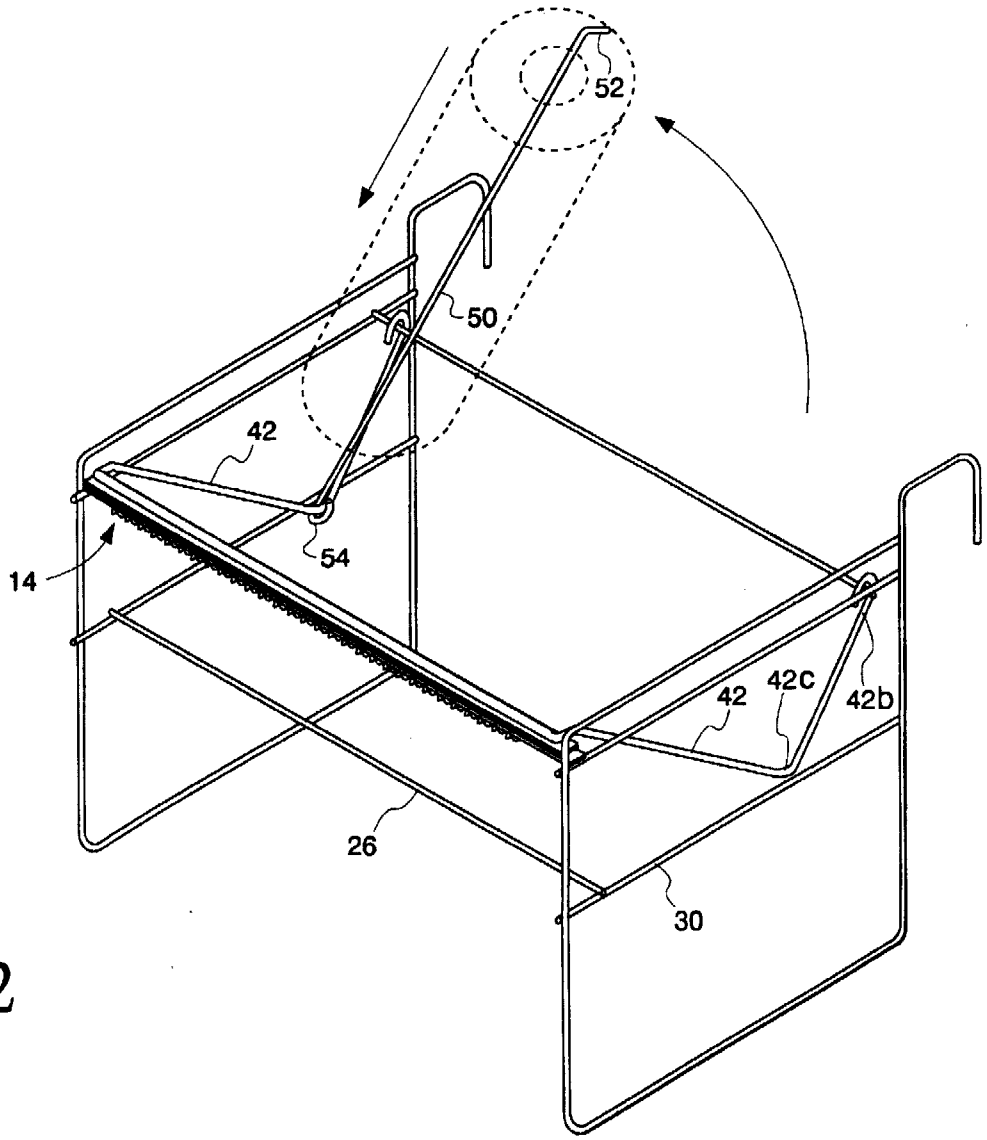
FIG. 2 shows a dispenser in a position for receiving a product roll.
Figure 3:
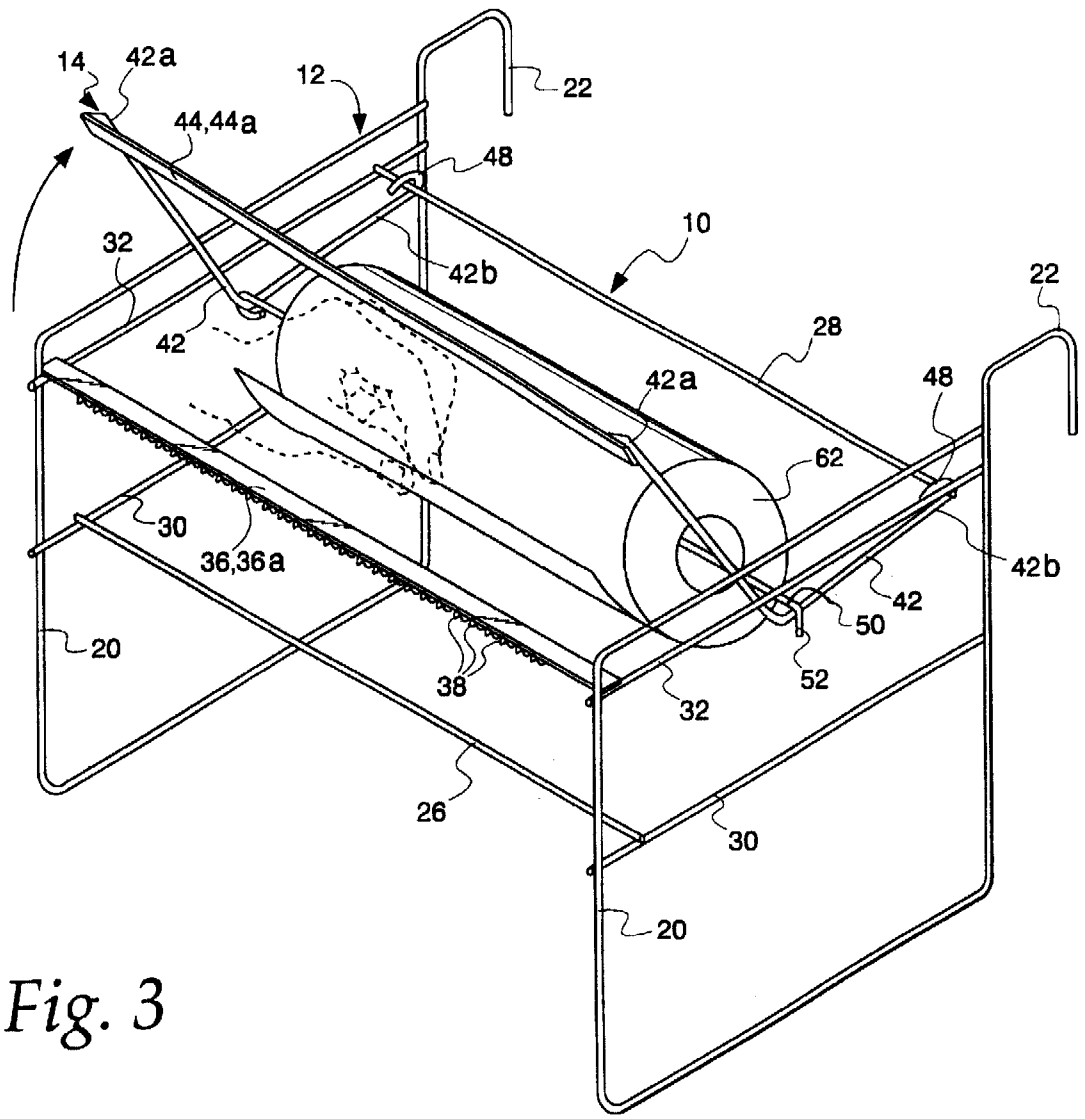
FIG. 3 shows the dispenser loaded with a product roll, with webbing from the product roll being readied for threading through the dispenser.

Referring now to the drawings, and initially to FIGS. 1–3, a dispenser is generally indicated at 10. The dispenser is preferably made of welded wire construction. The dispenser includes an outer frame generally indicated at 12 and an inner frame generally indicated at 14. As can be seen, for example, in FIG. 3, the inner frame 14 is pivotally mounted with respect to outer frame 12.

The outer frame 12 includes generally rectangular side members 20 which include hook members 22 for hanging support of the dispenser. Front and rear lateral supports 26, 28 extend between the side members 20. The front support 26 is supported by sidewall support members 30, whereas the rear lateral support 28 receives support from upper sidewall support members 32. A jaw member or a clamping bar 36 is also supported between upper support members 32. Clamping bar 36 preferably includes a plurality of teeth 38, although these can be omitted, if desired.

Referring to FIG. 3, the inner frame member 14 includes V-shaped side members 42, and a clamping bar 44 is supported between forward ends **42*a* thereof. Rearward ends 42*b* of the V-shaped side member 42 include loops 48 for pivotally mounting the inner frame member 14 about rear lateral support 28. As can be seen, for example, in FIG. 2, inner frame 14 further includes a support bar 50 having a hook-shaped free end 52 and a looped end 54 for pivotal mounting to one of the V-shaped side members 42**.

The clamping members 36, 44 preferably have smooth mating faces **36*a* and 44*a* which mate together in the manner shown in FIGS. 4–8 to form a nozzle or slot for guiding a web of flexible plastic bag material 60 extracted from a supply of the webbing material such as a fan-fold stack or, more preferably, a roll 62 mounted on support bar 50. As indicated in FIG. 2, support bar 50 is pivoted to a raised position, allowing the roll 62 to be telescopically inserted over the hooked end 52 of the support bar. The hooked end 52 is then lowered to engage the notch 42*c* of one of the V-shaped side supports 42. In the preferred embodiment, the web 60 is threaded through dispenser 10 in the manner indicated in FIG. 4. The webbing is paid out in a dispensing operation, being unrolled from roll 62, resulting in a pulling force toward the front of the dispenser. The support bar 50, however, is prevented from dislodgement in a forward direction since it is substantially held captive in the crotch 42*c* of the V-shaped side members 42, thus preventing the ends of the support bar 50** from moving in a forward direction.

As mentioned, the webbing can be provided in the form of a fan-fold stack. In order to conveniently mount the fan-fold stack so that support bar 50 carries the weight thereof, it has been found convenient to provide a wire basket (not shown) for holding the stack, which is either secured to the upper surface of support bar 50 (by welding, clamps or the like) or hung below support bar 50. In either event, the weight of the material will be borne by the inner frame 14 so as to apply a downward force to the (upper) clamping bar 44.

FIG. 3 shows the inner frame 14 in a raised position, preparatory to a threading operation. As will be appreciated, the weight of roll 62 is supported by the pivotally mounted inner frame 14 so as to urge upper clamping bar 44 against lower clamping bar 36, thus exerting a pressure against webbing 60 which is clamped between the jaws formed by bars 36, 44. If desired, additional weight could be added to the inner frame member 14. For example, frame members of increased mass (not shown) could be located adjacent the forward, free end of inner frame 14. Alternatively, the side support member 42 or the support bar 50 could be made of stock having an increased mass, or coil springs could be added between frame member 14 and frame member 12 to increase the clamping force applied to webbing 60, if desired. In any event, it can be seen that the compressive force applied to webbing 60 can be easily controlled with simple modifications to the dispenser.

Figure 4:
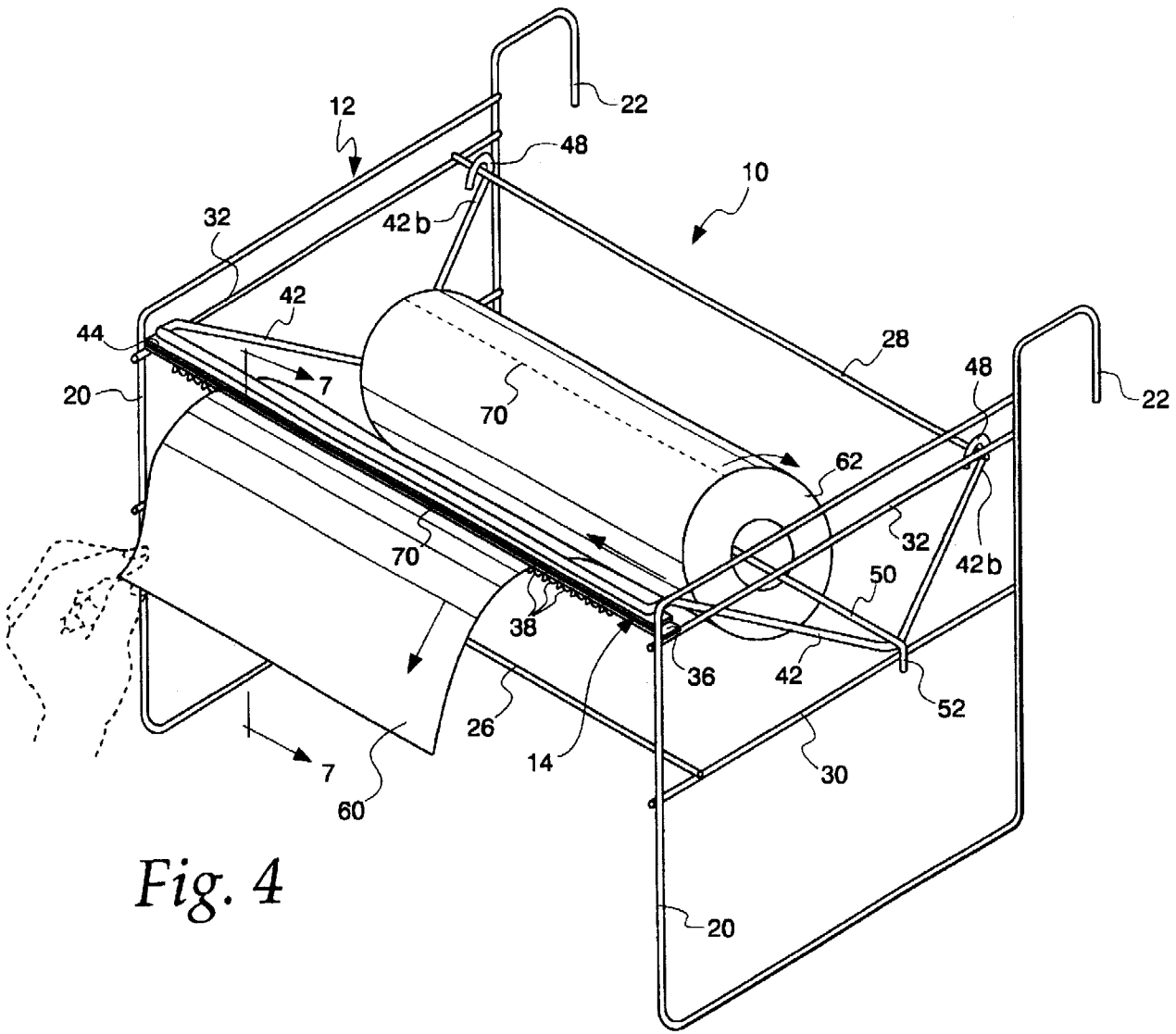
FIG. 4 shows the dispenser during a dispensing operation.

Referring again to FIG. 4, the webbing 60 is paid out and dispensed from roll 62, passing between clamping members 36, 44. The clamping force applied to webbing 60 introduces a controlled frictional force as the webbing is paid out. The frictional force smooths and regulates movement of the webbing, helping to ensure that the webbing is paid out at a constant and hence predictable rate of speed which will allow an operator greater control over positioning transverse lines of weakness 70 of the webbing with respect to the forward free edges of the clamping bars, where the teeth 38 are located. Due to the improved regulation of movement of the webbing from the dispenser, the operator can readily dispense and tear portions of the webbing in a one-handed operation, as indicated in FIG. 4. In the preferred embodiment, the webbing comprises a serial array of articles formed from the webbing. The articles are joined together along lines of weakness, preferably lines of perforations, to allow the articles to be readily severed from the balance of the webbing.

The clamping forces, arrangement of clamping members and the tearing edges of the clamping member prevents the webbing from being jerked out of position during a tearing operation, which might otherwise pull the lines of weakness (e.g. perforations) 70 away from their desired position, just forward of the tearing support edges **36*a*, 44*a* of the clamp members 36, 44. In the preferred embodiment, as illustrated in FIG. 4, it is preferred that the webbing be torn in a downward motion with clamping member 36 being relied upon to support the webbing during a tearing operation. However, if desired, the webbing could also be torn from the upper clamping member 44, particularly if the webbing is folded back over the roll 62** during a tearing operation.

Figures 5, 7:
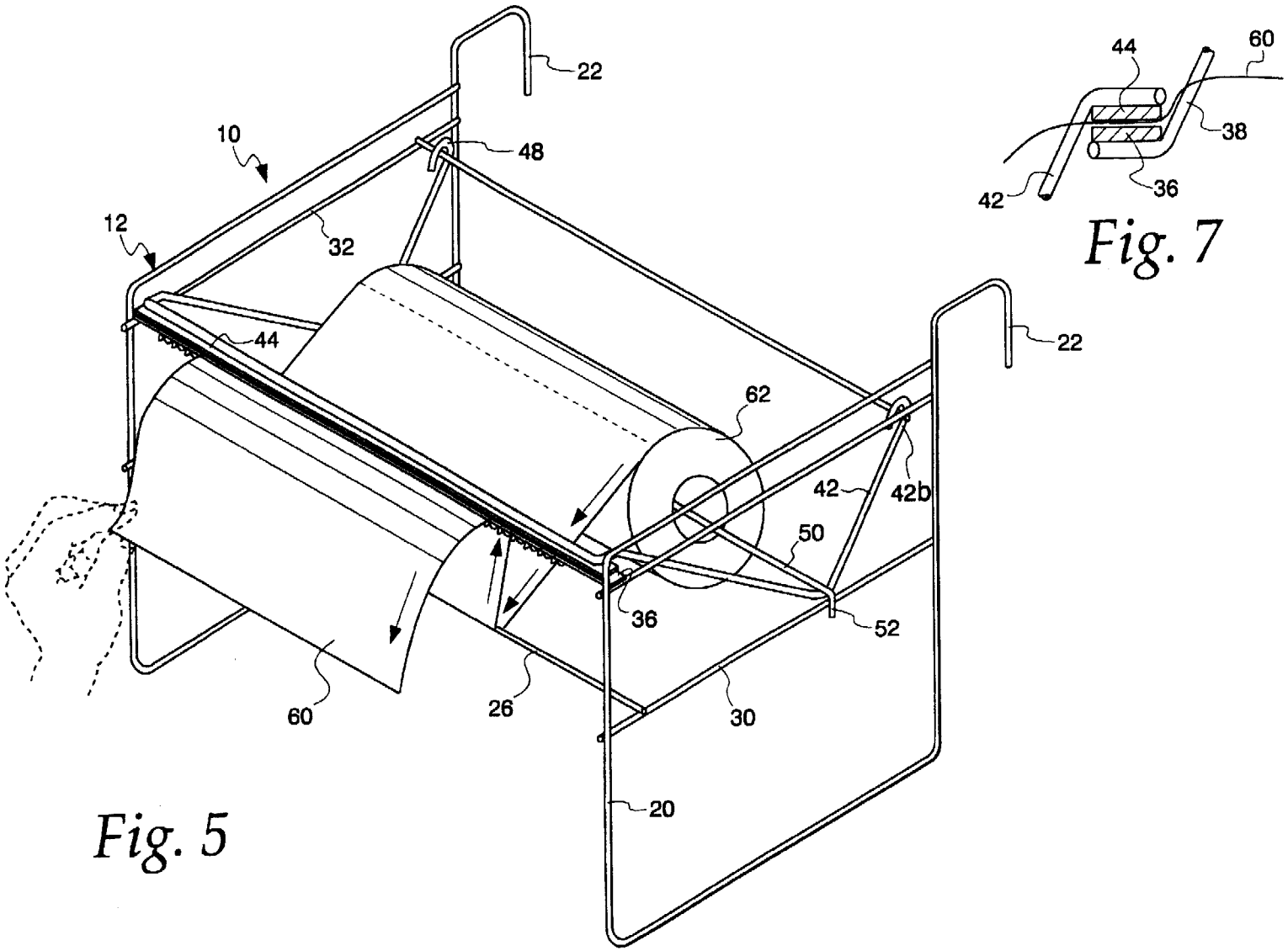
FIGS. 5 and 6 show alternative threading arrangements for the dispenser.
FIG. 7 is a fragmentary cross-sectional view taken along the line 7—7 of FIG. 4.
Figure 6:
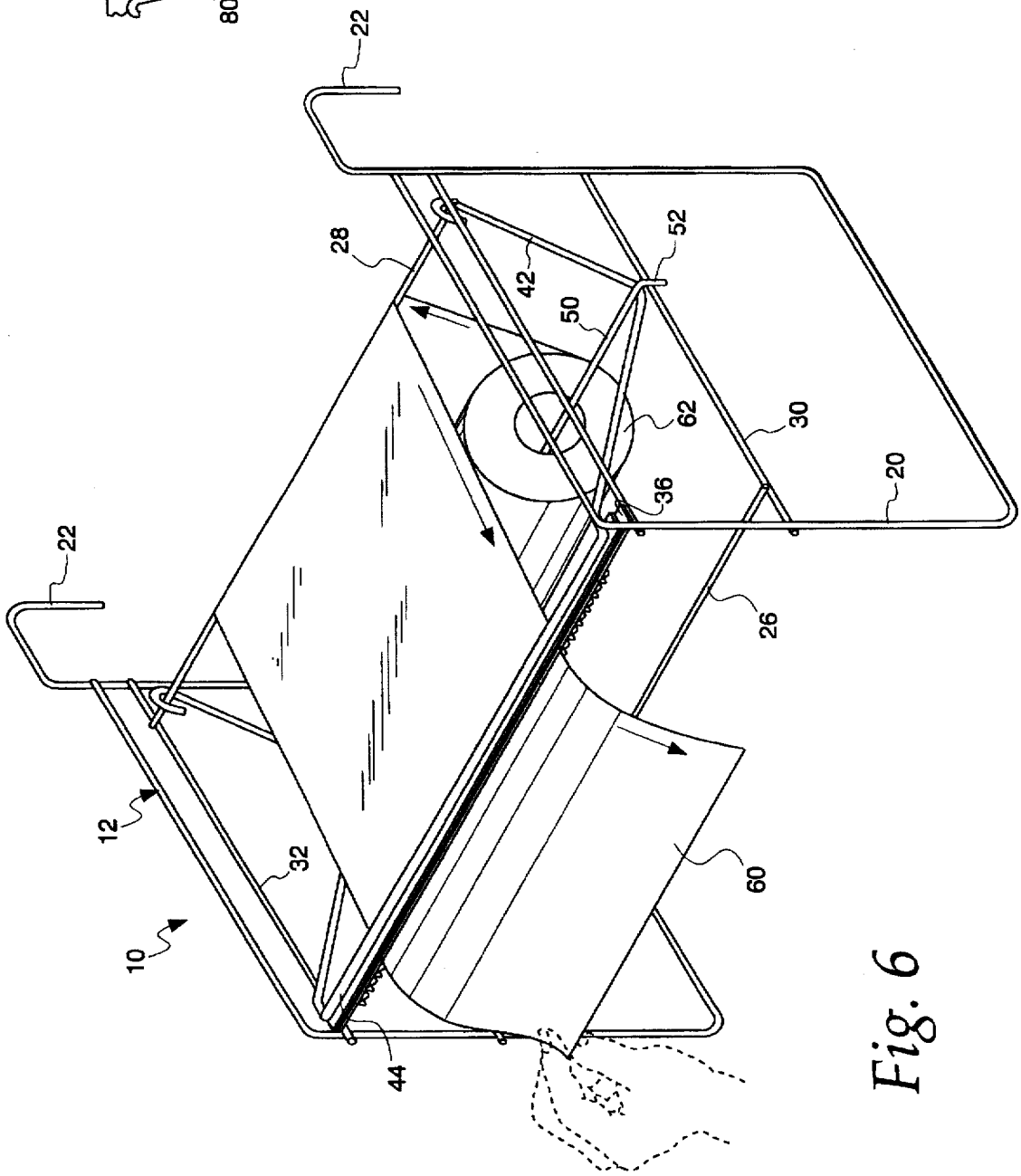
Figure 10:
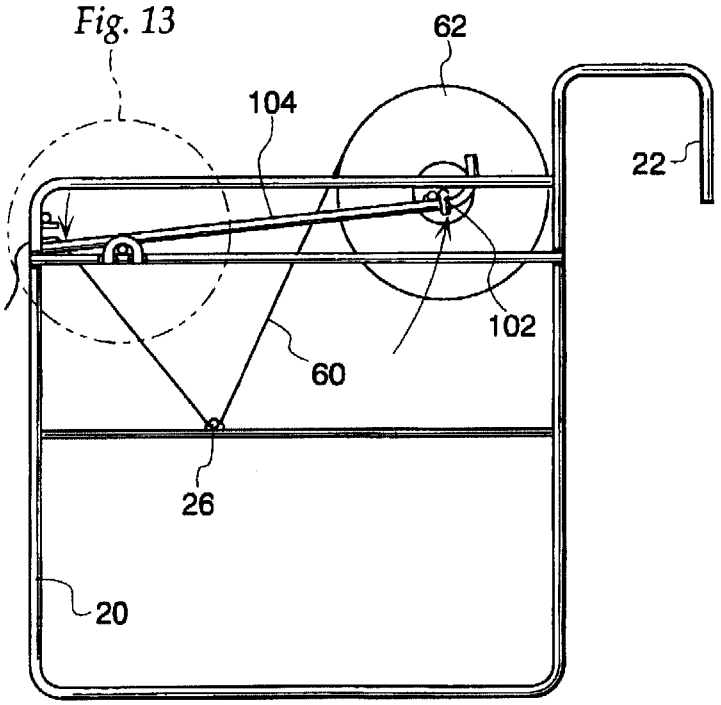
FIG. 10 is a view of similar to that of FIG. 9, but showing the clamping members in an open position.
Figure 9:
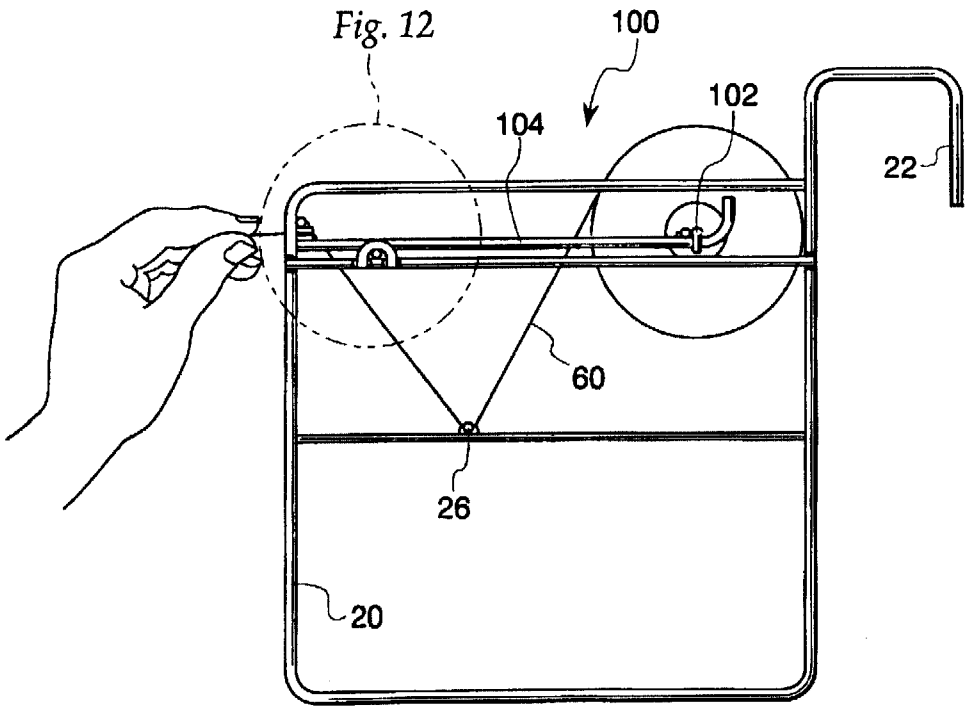
FIG. 9 is a side elevational view of an embodiment of the dispenser having a lower movable clamping member.

Referring to FIGS. 3 and 4, it is preferred that the webbing 60 be drawn from the bottom of roll 62, passing directly through the nozzle formed between clamping members 36, 44. However, other dispensing arrangements are possible. Turning to FIG. 5, the webbing 60 may be drawn from the top of roll 62 and, if additional friction is desired, the webbing may be looped over the forward lateral member 26 before passing between the clamping members 36, 44. FIG. 6 shows a further variation where webbing 60 is paid out from the bottom of roll 62, being drawn over rear lateral support 28 before passing between clamping bars 36, 44.

Figure 8:
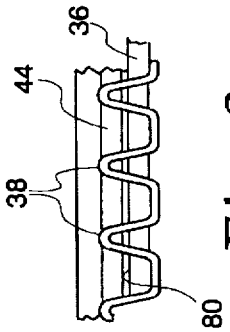
FIG. 8 is a fragmentary front elevational view of the fragment shown in FIG. 7.

Referring to FIGS. 7 and 8, the teeth 38 are preferably formed by bending a relatively small diameter wire in a zig-zag pattern. As can be seen in FIG. 8, it is preferred that the teeth 38 have smooth, rounded tips which engage the webbing passing through the gap or nozzle 80 formed between clamping bars 36, 44.

While it is preferred that the dispenser be made of welded wire material, it will now be recognized that the dispenser could also be fabricated from other materials such as aluminum, plastic and wood, for example.

Figure 11:
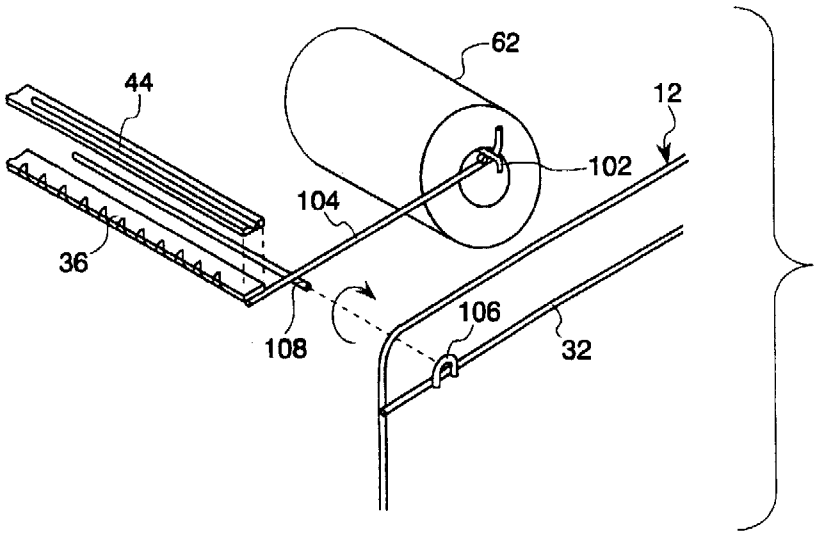
FIG. 11 is an exploded fragmentary perspective view thereof.

Referring now to FIGS. 9–13, another embodiment of the dispenser according to principles of the present invention is generally indicated at 100. The dispenser uses a wire frame member similar to that shown in FIG. 1, but with modifications to the support bar, and its pivotal mounting. In dispenser 100, support bar 102 has a hooked end to permit its selective locking with side support 104. Unlike the preceding embodiment shown in FIG. 1, side support 104 is mounted for pivoting rotation about upper support member 32. The hook-shaped retainer 106 is provided for receiving the free end of a transverse stub member 108. As indicated in FIG. 11, in the preferred embodiment, transverse support member 108 spans the distance between side support members of the frame, traversing the full extent of the clamping members 36, 44. However, if desired, transverse support member 108 can be made to extend only from side member 104, and need not traverse the extent of the clamping members.

Figure 13:
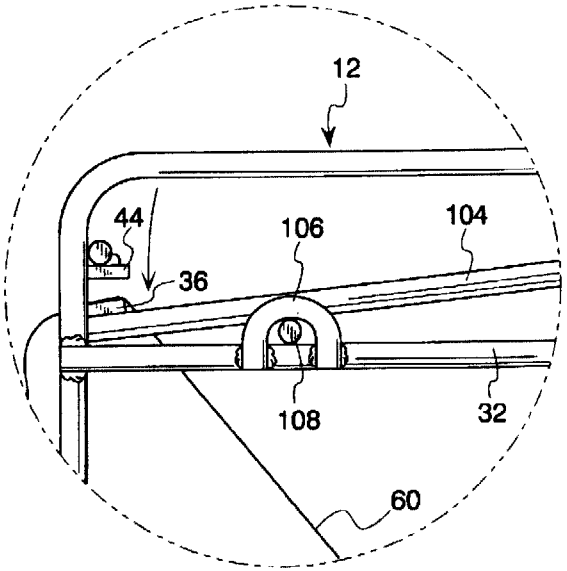
FIG. 13 shows a fragment of FIG. 10 on an enlarged scale.
Figure 12:
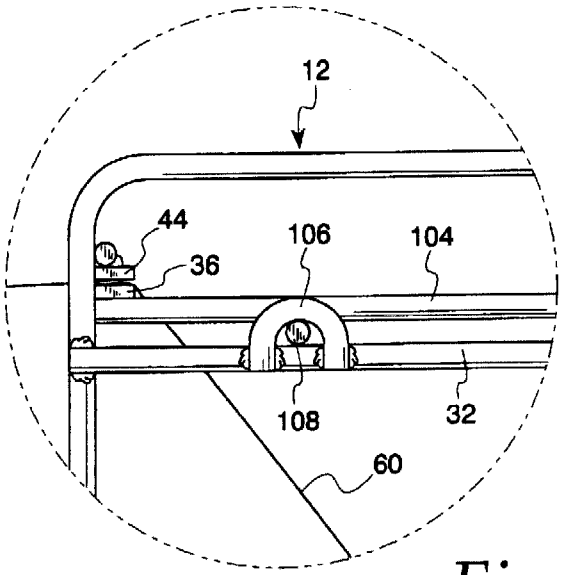
FIG. 12 shows a fragment of FIG. 9 on an enlarged scale.

In dispenser 100, the upper clamping member 44 is fixed to outer frame 12, as by welding its end portions to points on the outer frame 12, located immediately above upper support members 32, as shown, for example, in FIGS. 12 and 13. With the roll 62 mounted on support bar 102, an upward force is applied to the lower clamping member 36 by reason of the fulcrum for pivoting support between transverse support member 108 and upper support member 32. As shown, for example, in FIGS. 9 and 10, the webbing 60 drawn from roll 62 is fed underneath front support 26, being introduced between clamping members 36, 44.

Although the support member 104 is preferably constructed as a linear member without bends, other configurations providing a conventional fulcrum support are possible.

Figure 15:
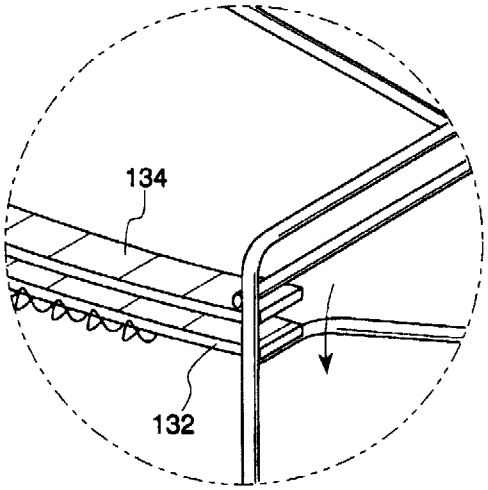
FIG. 15 shows a fragment of FIG. 14 on an enlarged scale.
Figure 14:
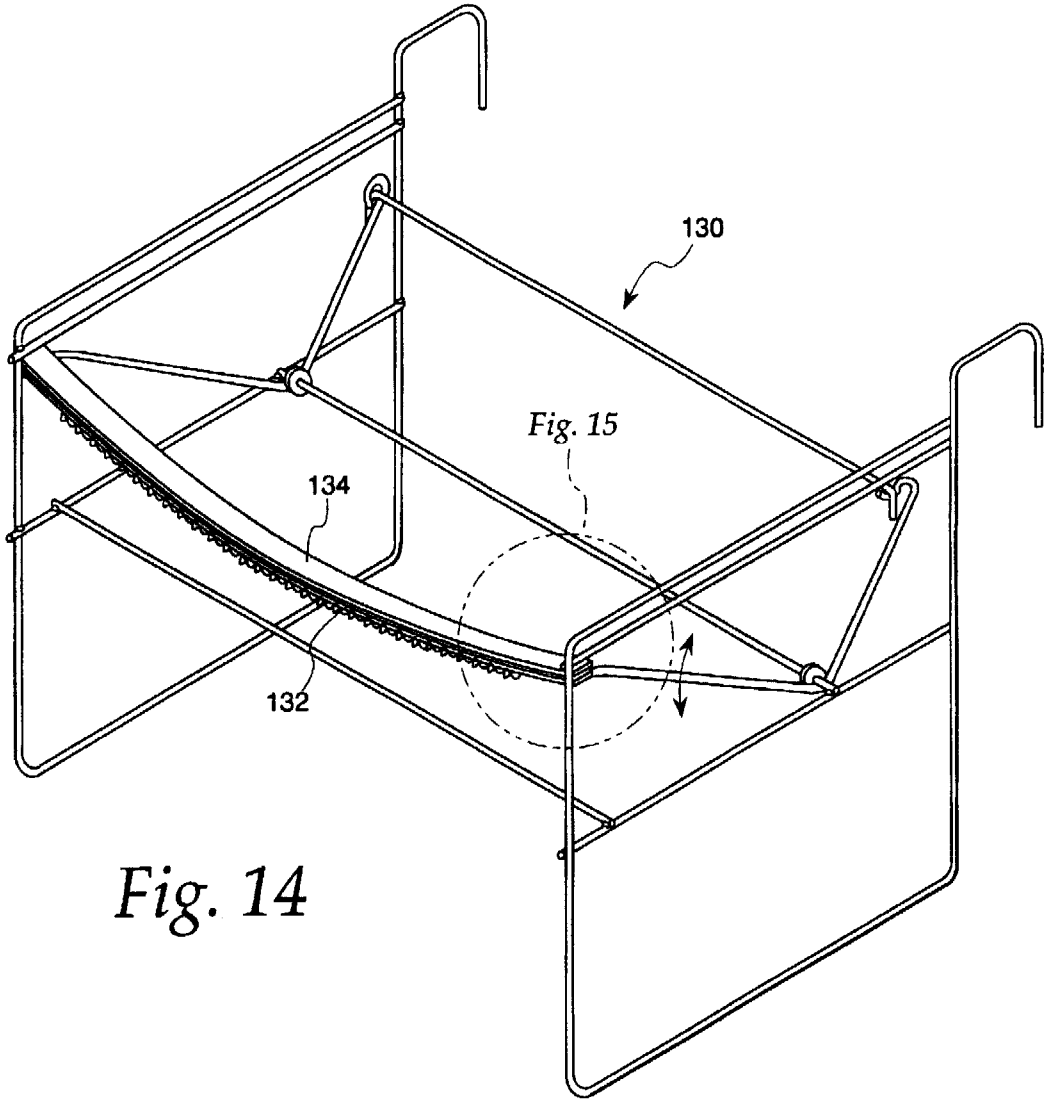
FIG. 14 is a perspective view of another embodiment of a dispenser according to the principles of the present invention.

Turning now to FIGS. 14 and 15, a dispenser generally indicated at 130 is substantially identical to dispenser 10 described above, except that the clamping members 36, 44 are replaced by clamping members 132, 134, respectively. Other aspects of the dispenser remain the same as that for dispenser 10. Clamping members 132, 134 are substantially identical to the afore-described clamping members 36, 44, respectively, except that the clamping members 132, 134 are bent in a vertical plane to take on an upwardly directed concave shape. The configuration of clamping members 132, 134 provide improved clamping of the webbing, especially webbing made of a flexible plastic film.

Figure 19:
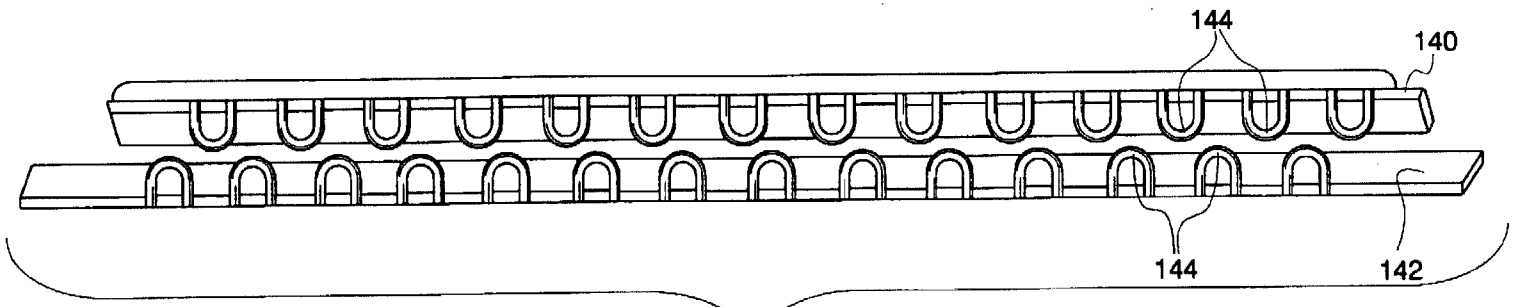
FIG. 19 is a fragmentary elevational view showing a portion of the clamping members of FIG. 18.
Figure 20:
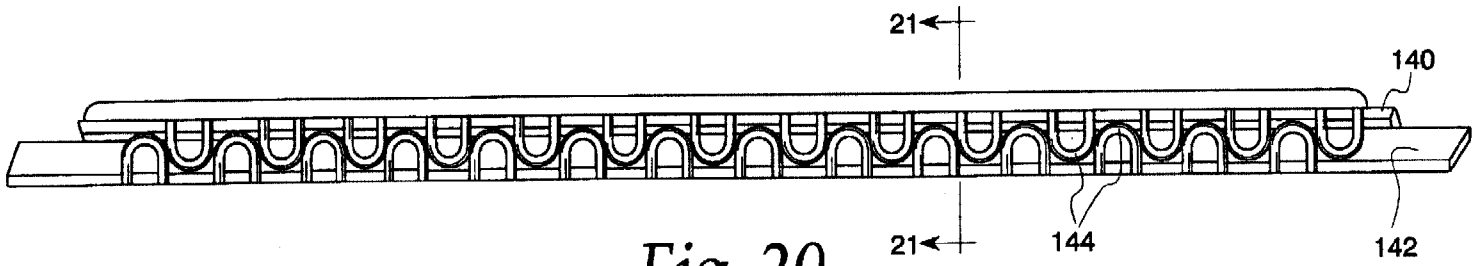
FIG. 20 is a view similar to that of FIG. 19 but showing the clamping members in a closed position.
Figure 21:
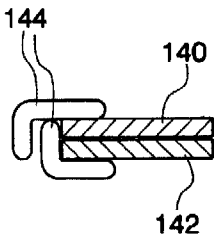
FIG. 21 is a cross-sectional view taken along the line 21—21 of FIG. 20.

The teeth carried on the clamping member 132 provide an improved positive engagement with so-called "perf lines" joining adjacent sections of the webbing together so that a user can conveniently tear portions of the webbing from the supply roll. If desired, the teeth carried on clamping member 132 can be transferred to the upper clamping member 134 or, alternatively, both clamping members 132, 134 can be provided with clamping teeth. An example of the clamping teeth which can be used is shown in FIGS. 19–21.

Figure 18:
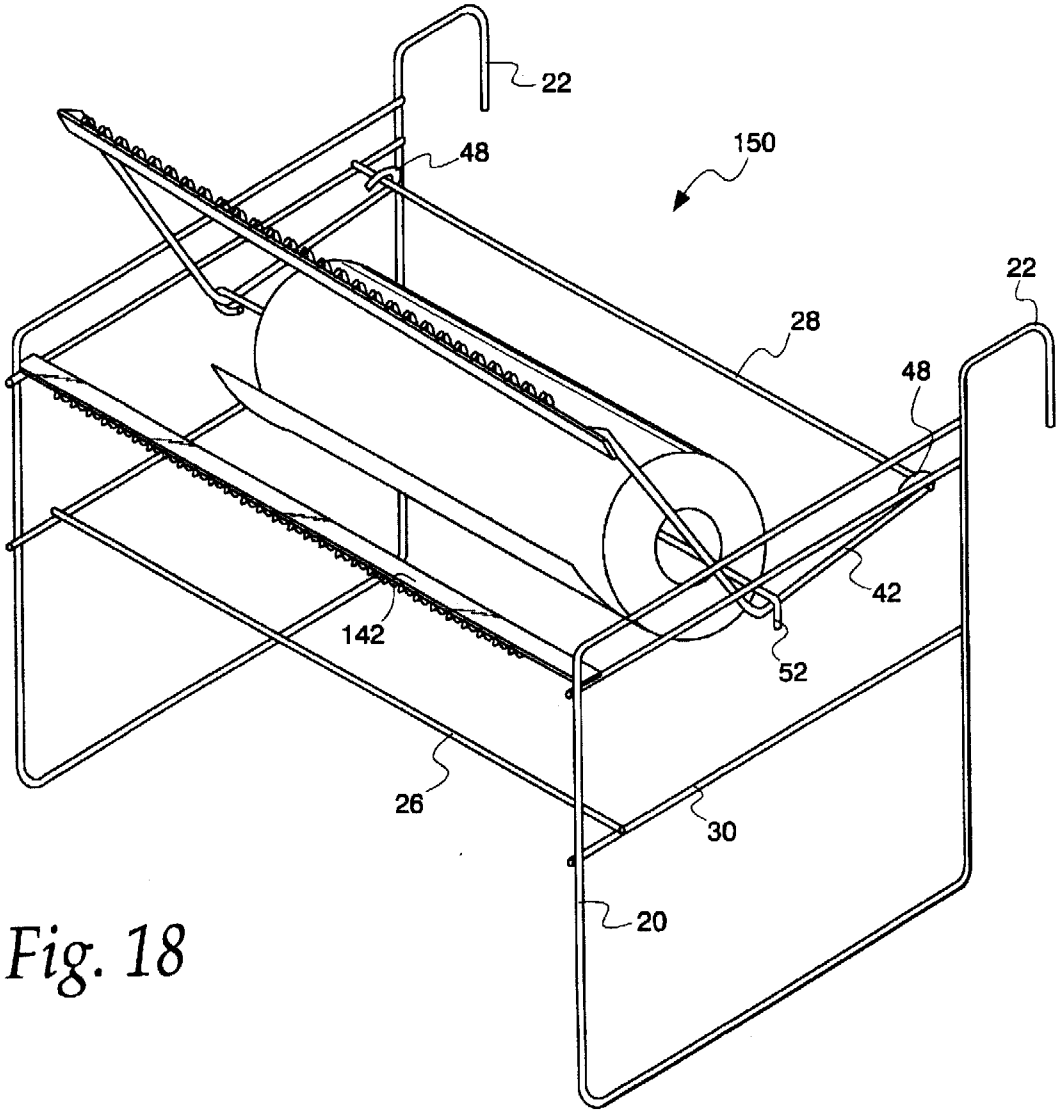
FIG. 18 is a perspective view of another embodiment of a dispenser according to the principles of the present invention.

Both upper and lower clamping members 140, 142 contain teeth 144 which are preferably rounded at their free ends. As shown in FIG. 20, the teeth on the upper and lower clamping members mesh together although, as can be seen in FIG. 21, the teeth of the clamping members are offset in a horizontal direction. In the preferred embodiment, the teeth carried on respective clamping members are arranged in a common plane, although alternating teeth of a clamping member can be staggered, with the teeth of the remaining clamping member similarly staggered within an opposite, complementary fashion so as to allow the clamping members a closure adequate to apply a clamping force to the webbing drawn through the clamping members. As shown in FIG. 21, the teeth on the lower clamping member 142 are located immediately adjacent the free edge of the clamping member, although the teeth carried on the lower clamping member can also be spaced from the clamping member as indicated with the upper clamping member of FIG. 21. FIG. 18 shows a dispenser 150 which is substantially identical to dispenser 10, shown above, except that clamping members 140, 142 are employed, rather than clamping members 44, 36.

Figures 16, 17:
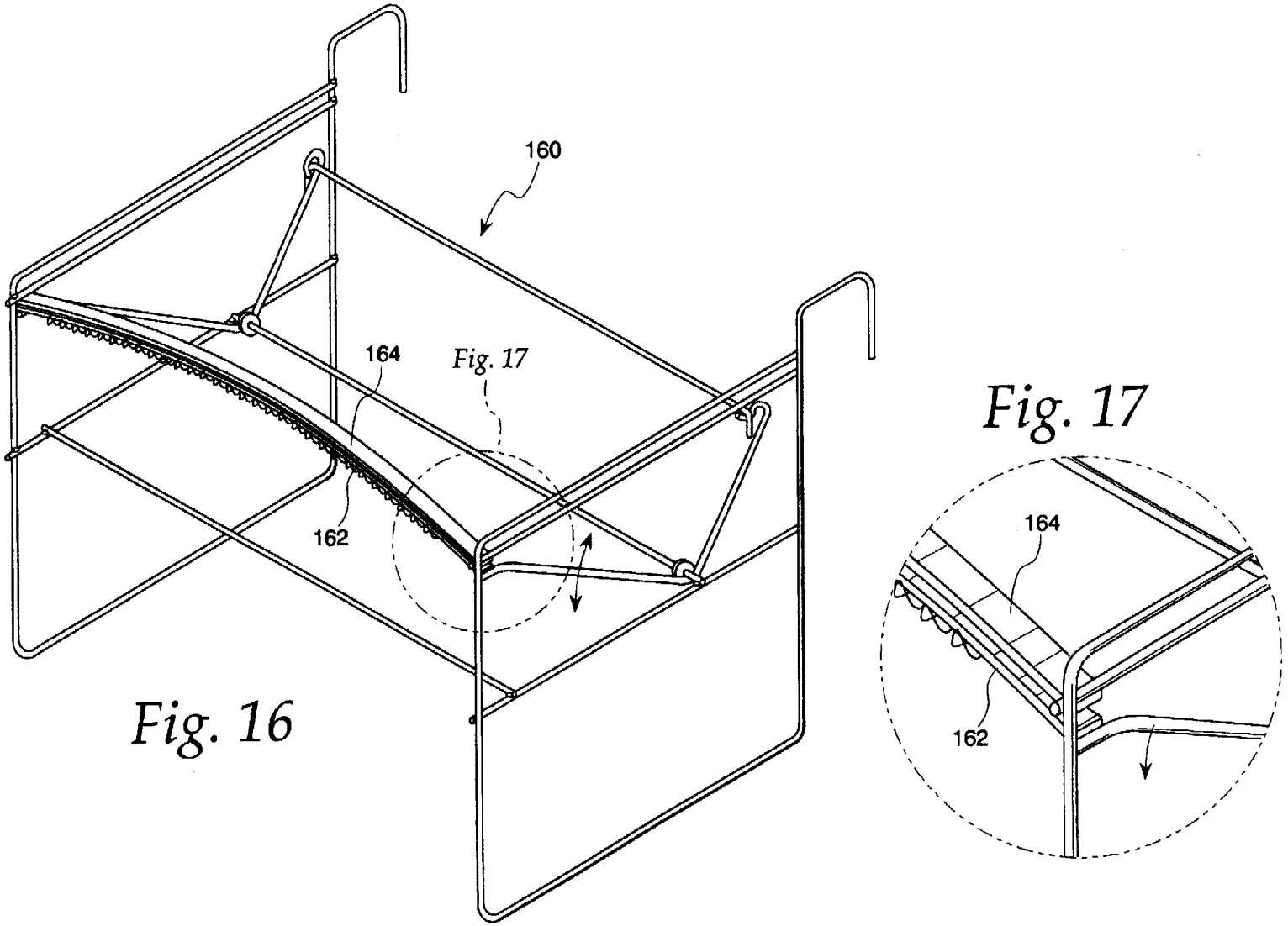
FIG. 16 is a perspective view of a further embodiment of a dispenser according to the principles of the present invention.
FIG. 17 is a fragment of FIG. 16 shown on an enlarged scale.

As mentioned above, FIGS. 14 and 15 show clamping members 132, 134 which have an upwardly directed concave shape. Turning now to FIGS. 16 and 17, a dispenser 160 is identical to dispenser 130, except that the clamping members 162, 164 have an oppositely directed curvature. As can be seen in FIG. 16, for example, the clamping members 162, 164 have a downwardly directed concave shape. As with the dispenser 130, it is the lower jaw which is movable, as indicated by the double headed arrows in FIGS. 14 and 16. However, if desired, the dispensers of FIGS. 14 or 16 can be constructed in the manner shown in FIG. 1 such that the lower clamping member is fixed while the upper clamping member is the one which moves.

The flexible web containing a continuous series of articles joined end-to-end along lines of weakness (e.g. perforations or the like) is shown in a simplified form in the figures. The present invention has found ready commercial advantages for use with T-shirt bags of the type commonly used in produce sections of food stores and the like. When provided in a continuous web, the T-shirt bags are joined at the ends of their handles to the bottom end of a neighboring bag in the web and is joined thereto along a line of weakness. Owing to their configuration, the handles of the T-shirt bags are considerably weaker than the body of the bags. Accordingly, the lines of weakness typically join bag portions having substantially resistances to tearing or stretching. For example, a substantial pulling force applied to the bottom of a T-shirt bag may not result in stretching or deformation of the bag, whereas application of the same force to the handles of the T-shirt bag would result in the undesirable stretching or tearing of those handles. By employing the principles of the present invention, a reliable consistent severing of the bottom of one bag form the handles of an adjacent bag are readily accomplished without injury to the bag handles. A representative sample of webbing for T-shirt bags, which find particular advantage from the present invention, can be found in U.S. Pat. Nos. 5,096,305; 4,911,560; 4,807,754; 4,786,275; and 4,692,134.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A dispenser for flexible webbing having a free end and comprising a serial array of articles joined end to end along lines of weakness, the dispenser comprising:

a first frame means including a first jaw member;

a second frame means for supporting a supply of the webbing as the free end is withdrawn from the first frame means, said second frame means including a second jaw member;

pivotal mounting means for mounting the second frame means for pivotal movement with respect to the first frame means, between closed and open positions so as to move the first jaw member toward and away from the second jaw member;

the first and the second jaw members cooperating to form a dispensing nozzle for guiding the webbing with a frictional engagement as the webbing is passed between the first and the second jaw members and for supporting the webbing as articles are severed the webbing by tearing along lines of weakness; and the pivotal mounting means arranged so that the weight of the webbing urges the first and the second jaw members together so as to form the dispensing nozzle and to frictionally engage the webbing.

2. The dispenser of claim 1 wherein said first jaw member includes a plurality of teeth for engaging the webbing.

3. The dispenser of claim 2 wherein said second jaw includes a relatively smooth clamping surface facing the first jaw member.

4. The dispenser of claim 3 wherein said first jaw includes a relatively smooth clamping surface adjacent the teeth facing the second jaw member.

5. The dispenser of claim 2 wherein said second frame means comprises two V-shaped side members having first and second ends and an intermediate crotch portion, the side members joined together by a lateral member joined to first free ends of the V-shaped side members.

6. The dispenser of claim 5 wherein said second frame means further comprises a webbing support bar pivotally connected to one of the V-shaped side members so as to be releasably engageable with the other V-shaped side member.

7. The dispenser of claim 6 wherein said second frame means comprises side walls joined together by two lateral support members, and second ends of said V-shaped side members are pivotally connected to one of the lateral support members.

8. The dispenser of claim 6 wherein said frame teeth have upper ends extending above the first jaw member.

9. The dispenser of claim 7 wherein the webbing support member has first and second ends, with the first end pivotally joined to one side member and the other end having a hook portion for releasable joinder to the other side member so as to receive a roll of webbing.

10. The dispenser of claim 9 wherein the webbing support member is located below the lateral support member which is pivotally connected to the V-shaped side members.

11. The dispenser of claim 1 wherein said first and said second jaw members have a generally arcuate shape.

12. The dispenser of claim 1 wherein said first jaw member is located above the second jaw member and the weight of the webbing urges the first jaw member in a downward direction.

13. The dispenser of claim 1 wherein said first jaw member is located below the second jaw member and the weight of the webbing urges the first jaw member in an upward direction.

14. The dispenser of claim 1 wherein said first and said jaw members carry respective pluralities of teeth, with the teeth of the first jaw member disposed in serially alternating relationship with the teeth of the second jaw member.

15. The dispenser of claim 1 wherein the teeth of said first and said jaw members are offset from one another in the direction of the webbing.

16. A dispenser for plastic webbing having a free end and comprising a serial array of bags joined end to end along lines of perforation, the dispenser comprising:

a first frame means including a first jaw member;

a second frame means for supporting a supply of the webbing as the free end is withdrawn from the first frame means, said second frame means including a second jaw member;

pivotal mounting means for mounting the second frame means for pivotal movement with respect to the first frame means, between closed and open positions so as to move the first and the second jaw members toward and away from each other;

the first and the second jaw members cooperating to form a dispensing nozzle for guiding the webbing with a frictional engagement as the webbing is passed between the first and the second jaw members and for supporting the webbing as bags are severed from the webbing by tearing along lines of perforation; and the pivotal mounting means arranged so that the weight of the webbing urges the first and the second jaw members together so as to form the dispensing nozzle and to frictionally engage the webbing.

17. The dispenser of claim 16 wherein said first and said second jaw members have a generally arcuate shape.

18. The dispenser of claim 16 wherein said first jaw member is located above the second jaw member and the weight of the webbing urges the first jaw member in a downward direction.

19. The dispenser of claim 16 wherein said first jaw member is located below the second jaw member and the weight of the webbing urges the first jaw member in an upward direction.

20. The dispenser of claim 16 wherein said first and said jaw members carry respective pluralities of teeth, with the teeth of the first jaw member disposed in serially alternating relationship with the teeth of the second jaw member.

21. The dispenser of claim 16 wherein the teeth of said first and said jaw members are offset from one another in the direction of the webbing.

22. The dispenser of claim 16 wherein said first jaw member includes a plurality of teeth for engaging the webbing and said second jaw member includes a relatively smooth clamping surface facing the first jaw member.

23. A dispenser for flexible webbing having a free end and comprising a serial array of articles joined end to end along lines of weakness, the dispenser comprising:

a first frame means including a first jaw member including a plurality of teeth for engaging the webbing adjacent a relatively smooth clamping surface;

a second frame means for supporting a supply of the webbing as the free end is withdrawn from the first frame means, said second frame means including a second jaw member having a relatively smooth clamping surface facing the first jaw member;

pivotal mounting means for mounting the second frame means for pivotal movement with respect to the first frame means, between open and closed positions so as to move the first and the second jaw members toward and away from each other;

the first and the second jaw members cooperating to form a dispensing nozzle for guiding the webbing with a frictional engagement as the webbing is passed between the first and the second jaw members and for supporting the webbing as articles are severed by tearing along lines of weakness; and the pivotal mounting means arranged so that the weight of the webbing urges the first and the second jaw members together so as to form the dispensing nozzle and to frictionally engage the webbing.

24. The dispenser of claim 23 wherein said frame teeth have upper ends extending above the first jaw member.

25. The dispenser of claim 23 wherein said second frame means comprises two V-shaped side members having first and second ends and an intermediate crotch portion the side members joined together by a lateral member joined to first free ends of the V-shaped side members and wherein said second frame means further comprises a webbing support bar pivotally connected to one of the V-shaped side members so as to be releasably engageable with the other V-shaped side member.

26. The dispenser of claim 23 wherein said frame teeth have upper ends extending above the first jaw member.

27. A dispenser for flexible webbing having a free end and comprising a serial array of articles joined end to end along lines of weakness, the dispenser comprising:

a first frame means including a first jaw member including a plurality of teeth for engaging the webbing adjacent a relatively smooth clamping surface;

a second frame means for supporting a supply of the webbing as the free end is withdrawn from the first frame means, said second frame means including a second jaw member having a relatively smooth clamping surface facing the first jaw member, said second frame means further including two V-shaped side members having first and second ends and an intermediate crotch portion joined together by two lateral members, one joined to the crotch of the V-shaped side members and the other joined to first free ends of the V-shaped side members and the second frame means also comprising a webbing support bar pivotally connected to one of the V-shaped side members so as to be releasably engageable with the other V-shaped side member;

pivotal mounting means for mounting the second frame means for pivotal movement with respect to the first frame means, between open and closed positions so as to move the first and the second jaw members toward and away from each other;

the first and the second jaw members cooperating to form a dispensing nozzle for guiding the webbing with a frictional engagement as the webbing is passed between the first and the second jaw members and for supporting the webbing as articles are severed by tearing along lines of weakness; and the pivotal mounting means arranged so that the weight of the webbing urges the first and the second jaw members together so as to form the dispensing nozzle and to frictionally engage the webbing.

28. The dispenser of claim 27 wherein said second frame means comprises side walls joined together by two lateral support members, and second ends of said V-shaped side members are pivotally connected to one of the lateral support members.

29. The dispenser of claim 27 wherein said frame teeth have upper ends extending above the first jaw member.

30. The dispenser of claim 27 wherein the webbing support member has one and two ends, with the first end pivotally joined to one side member and the other end having a hook portion for releasable joiner to the other side member so as to receive a roll of webbing.

* * * * *